US005741060A

United States Patent [19]

Johnson

[11] Patent Number: 5,741,060

[45] Date of Patent: Apr. 21, 1998

[54] BASEBALL CAP LIGHT

[76] Inventor: Thomas R. Johnson, 2217 NE. 6th Pl., Renton, Wash. 98056

[21] Appl. No.: 697,614

[22] Filed: Aug. 28, 1996

[51] Int. Cl.[6] ..... F21L 15/14

[52] U.S. Cl. ..... 362/106; 362/191; 362/184

[58] Field of Search ..... 362/103, 105, 362/106, 184, 190, 191, 806; 2/209.13

[56] References Cited

U.S. PATENT DOCUMENTS

| | | | |
|---|---|---|---|
| 539,191 | 5/1895 | Rodrigues et al. | 362/106 |
| 897,588 | 9/1908 | Cogswell et al. | 362/106 |
| 1,146,979 | 7/1915 | Walters et al. | 362/106 |
| 1,242,211 | 10/1917 | Leihgeber | 362/106 |
| 1,572,210 | 2/1926 | Kolibas | 362/106 |
| 1,744,777 | 1/1930 | Lundgren | 362/106 |
| 4,827,384 | 5/1989 | Von Schlemmer | 362/106 |
| 4,991,068 | 2/1991 | Mickey | 362/106 |
| 5,541,816 | 7/1996 | Miserendino | 362/106 |

FOREIGN PATENT DOCUMENTS

| | | | |
|---|---|---|---|
| 1221782 | 6/1960 | France | 362/106 |
| 4289602 | 10/1992 | Japan | 362/105 |

*Primary Examiner*—Thomas M. Sember
*Attorney, Agent, or Firm*—Harry W. Cross, Jr.

[57] ABSTRACT

A combination baseball style cap and light assembly, wherein the cap has a crown, a bill extending from the crown, a sweatband liner circumscribing the bottom edge of the cap, and a reinforcing crown liner, has a double light and switch assembly comprising two lamp sockets affixed to a mounting plate on each side of a sealed sub-mini micro switch also affixed to the mounting plate. The plate is in turn affixed to the underside of the bill of the cap, two lamp sockets affixed to the mounting plate such that their axes decline at an acute angle to the plane of the plate and converge at an acute angle to a line perpendicular to the front edge of the plate, setting the focal point of the lamps at a predetermined location directly out from and generally equidistant between the wearers eyes. A micro switch is affixed to an integral mounting flange on the mounting plate located approximately on the center line of the mounting plate between the two sockets. First and second battery holders are each affixed respectively to each side of the center line of the top edge of the reinforcing element of the crown of the cap and the top edge of the crown of the cap, and a circuit electrically couples the micro switch, the lamp sockets and the battery holders.

10 Claims, 3 Drawing Sheets

BASEBALL CAP LIGHT

BACKGROUND OF THE INVENTION

1. Field of the Invention

This invention relates to lamps mounted to caps and hats. In particular, this invention relates to lamps mounted to the visor of baseball-type caps.

2. Brief Description of the Prior Art

The need for hands-free operation of personal lighting devices has led to a myriad of inventions, some successful, yet, many remaining only ideas. The range of head mounted lamp inventions includes the classic "miners hat", the old style carbide lamp mounted on miners' hard hats, to the Leihgeber Cap (U.S. Pat. No. 1,242,211), a combination cap and lamp invention fashioned from early century driving hats, which, among many features, included a bill with a reflective underside to enable its wearer to see objects behind without turning about. These inventions were precipitated by the need to illuminate a wide variety of activities while keeping ones hands free for other uses. These activities include everyday occurrences such as lighting ones pathway or door lock; lighting a work task such as changing spark plugs under the hood of a car or tightening a bolt under the dashboard; or lighting a recreational activity such as the handhold for the pre-dawn rock climber or the bail and hook in the hands of a late evening fisherman; and emergency situations such as changing a tire on a dark, rainy evening or resetting a tripped circuit breaker in a blackened basement. The cap light also has innumerable work place applications ranging from night operations for those in law enforcement and the military to night time flight line works and commercial fishermen.

Given the great popularity of the common lightweight baseball style cap, an invention which couples a lamp assembly with a baseball cap in an unobtrusive manner would offer functional hands-free lighting with a cap style acceptable to a broad diversity of people. Many of the combination cap-lamp inventions depend on a custom cap portion of the invention, as well as the lamp and power source assembly. Many represent cap styles possibly more acceptable at the date of the invention or are styles not aesthetically suited for everyday use. Only a few, including the Mickey, Lamp Attachment for Hat (U.S. Pat. No. 4,991,068) combine as existing cap design with a lamp assembly.

It is viewed that the most important keys to the combination baseball style cap and lamp assembly is to integrate the lamp assembly in the least visibly obtrusive way possible, keep the lamp and power source as inconspicuously lightweight as possible, minimize alterations to the commonly manufactured baseball styled hat, and to enable the wearer to have the task at hand directly and adequately illuminated for a reasonable duration without creating glare for the wearer. Attempts to accomplish these key features in other inventions, including the Mickey Lamp Attachment for Hat, were either too heavy, consisted of a remote (from hat) power source, produced relatively insufficient light, or consisted of a light source assembly that significantly altered the appearance of the hat.

SUMMARY OF THE INVENTION

Derived from the need for hands-free operation of lamps for a diversity of emergency, recreation, household and work place uses, the cap light combines the highly popular baseball style cap and a unique lamp assembly. The cap light invention provides a significantly improved version of combined hat and lamp and head mounted lamp inventions.

The cap light is an invention which significantly improves upon previous combination hat/lamp inventions by providing a combination baseball style hat and lamp assembly which does not visibly alter the normal aesthetic appearance of the baseball cap, yet, provides a relatively strong light source which is directed at the normal field of vision of the cap light wearer.

The cap light assembly is designed to be fitted to a commonly manufactured baseball style cap and comprises a simple dual lamp, switch and battery assembly as illustrated in FIGS. 1–4. The assembly is relatively lightweight (2.2 oz. including batteries and 0.5 ox without), not affecting the wear-ability of the cap over an extended period. The assembly also consists of two commonly switched, commercially available lamps enabling relatively strong illumination for use at night or in low light situations. The lamps are wired in series enabling one to operate while the other is inoperative, offering a redundancy for emergency situations. One lamp could also be removed to double the life of the batteries. The assembly is powered by two commercially available AA sized alkaline batteries enabling the assembly to function the same length of time as a penlight, although it is anticipated the user would only intermittently use the lights. The user has the option of substituting commercially available AA sized rechargeable batteries.

In accordance with the foregoing, the invention comprises a combination baseball style cap and light assembly, the cap having a crown, a bill extending from the crown, a sweatband liner circumscribing the bottom edge of the cap, and a reinforcing crown liner, and the combination including: a double light and switch assembly comprising two lamp sockets affixed to a mounting plate on each side of a sealed sub-mini micro switch also affixed to the mounting plate, which plate is in turn affixed to the underside of the bill of the cap; two lamp sockets affixed to the mounting plate such that their axes decline at an acute angle to the plane of the plate and converge at an acute angle to a line perpendicular to the front edge of the plate, setting the focal point of the lamps at a predetermined location directly out from and generally equidistant between the wearers eyes; a sub-mini micro switch affixed to an integral mounting flange on the mounting plate located approximately on the center line of the mounting plate between the two sockets; first and second battery holders each affixed respectively to each side of the center line of the top edge of the reinforcing element of the crown of the cap and the top edge of the crown of the cap; and circuit means electrically coupling the micro switch, the lamp sockets and the battery holders.

DESCRIPTION OF THE PREFERRED EMBODIMENT

The commonly manufactured baseball style cap generally consists of a fabric hat having a crown, a bill extending from the crown, a reinforcing crown liner, and an inner sweat band extending around the circumference of the hat. The cap is manufactured with either a fixed hat size or is fitted with plastic straps at the rear of the inner sweat band to enable adjustment of the hat size. The crown is usually made of various fabrics (felt, canvas, corduroy, etc.) dyed a single color. A wide variety of team and corporate company logos are usually affixed to the crown. The bill is usually constructed of fabric reinforced with an inner cardboard or plastic stiffener and is made in the same color as the crown or a separate color. The bill is sometimes constructed with different colors on its top and bottom.

Figure 5:
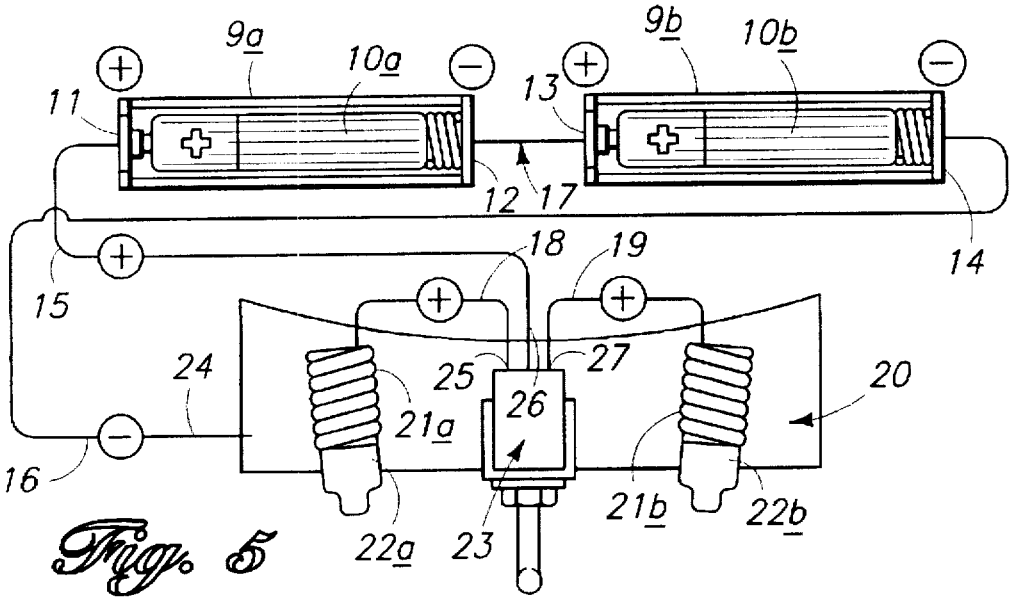
FIG. 5 is an electrical schematic of the cap light assembly.
Figure 6:
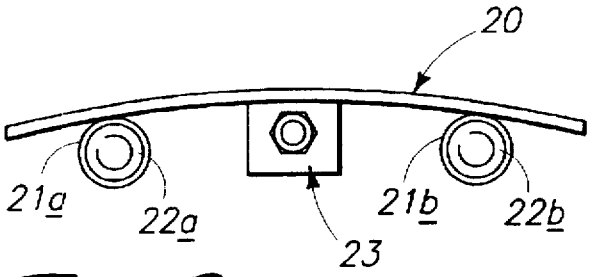
FIG. 6 is a detailed elevation view for the lamp and lamp switch subassembly mounted to the underside of the cap bill.
Figure 7:
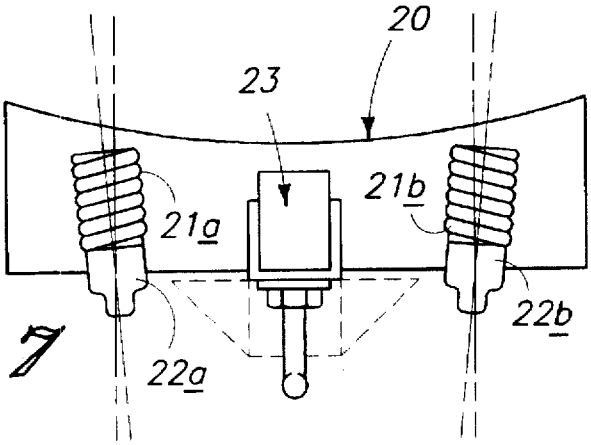
FIG. 7 is a detailed bottom elevation view of the FIG. 6 lamp and lamp switch subassembly.

FIGS. 5–7 depict the battery, light and switch assemblies, respectively. The cap light invention affixes a light and switch assembly to the underside of a cap's bill with small brass bolts. Two commercially available battery carriages (Radio Shack Catalog No. 270-401, or equivalent), each holding a single AA sized battery, are affixed to the upper inside surface of the reinforcing crown liner with silicon glue. The battery carriages are connected to each other by wiring effecting a series electrical circuit. Wires from the battery carriages serving the light and switch assembly are routed on the backside of the reinforcing crown liner, behind the sweat band and between the lower side fabric covering of the bill and its internal reinforcing stiffener to the backside of the light and switch assembly. The wires are then soldered to the appropriate lamp and switch assembly leads to effect a parallel circuit to each lamp controlled off and on by a "sub-mini" micro switch. This enables the one lamp to remain operative while the other is removed or disabled.

The battery carriages are placed within the hat in the least obtrusive and most stable location. They are mounted above the wearers' head on the intersection of the top edge of the reinforcing element of the crown and the top edge of the crown of the cap making the battery carriages unnoticeable to the wearer both in terms of weight and pressure on the wearer's head and to those viewing the cap on the wearer's head. This location also reinforces the structure of the cap making it more stable in the event of rain. Previous inventions including the Mickey Lamp Attachment for Hat placed the battery assemblies in such a location (behind the sweat band liner) to put pressure on the wearer's head causing potential wearer discomfort; required a custom battery design such as the Walters, Beckman and Kohl Trouble Lamp (U.S. Pat. No. 1,146,979); or placed the battery in a remote assembly, affixing to a belt or to be held in a pocket, presenting complications such as entanglement in the wires. The cap light battery carriages use commercially available batteries and allow easy change of batteries. They are light weight, not visible when wearing the cap light and do not alter the manner in which the baseball style cap is commonly worn.

The light and switch assembly is comprised of a stainless steel mounting plate approximately 0.75 inches wide by 3.0 inches long with 2 small holes at each end to affix the lamp assembly to the bill of the hat with four small brass nut and bolts. The mounting plate is slightly curved to match the curvature of the bill of the hat and hollow-ground along its back edge to enable the plate to be mounted as far back on the cap bill as possible without touching the forehead. A commercially available sub-mini micro switch (Radio Shack Catalog No 275-645, or equivalent) is affixed to the mounting tab, integral with the mounting plate, between the lamp sockets. It enables the wearer to easily switch the lamps on and off with the thumb of either hand. Two commercially available lamp sockets (Radio Shack) are each permanently soldered to the mounting plate. A commercially available pre-focused, pen light lamp (Radio Shack Catalog No. 272-1124, or equivalent) is installed in each lamp socket.

The lamps are mounted at precisely 22.50 degrees to the mounting plate, and 3.0 degrees to a line perpendicular to the leading edge of the mounting plate. With the cap light worn normally (bill of the hat level) the axes of the beams of light from each lamp intersect at the wearer's normal horizontal and vertical line of vision approximately 20–24 inches from the wearers eyes, or the optimal focal distance for a human's close-in vision. It also places the axes of the beams of light from the lamp well within the wearer's normal vertical cone of vision enabling the light beam to illuminate more distant objects without any directional adjustment to the beams of light. However, should the wearer desire adjustment of the light beams, either the head can merely be turned or tilted or the hat can be tilted up or down or rotated left or right. Many previous inventions ranging from the Mickey Lamp Attachment for Hat and the Lundgren Cap Supported Lamp (U.S. Pat. No. 1,744,777) to the Cogswell and Abel Miner's Cap and Lamp (U.S. Pat. No. 897,588) have adjustably directed lamps, making the lamp assemblies larger and more complex. Since the human eye will focus on the illuminated object, a beam of light within the normal cone of vision makes directional control of the beam moot. The wearer would merely turn his/her head left or right or tilt his/her head up or down to change the direction of the light beam. The cap light lamp mounting system enables a simple, fixed lamp system which still offers optimal directional flexibility.

The back edge of the light and switch assembly mounting plate is concavely curved at a similar curvature as the back edge of the cap's bill to enable the mounting plate to be located such that the back edge of the mounting plate is 0.125 inches from the back edge of the bill. This offers easy access to the switch, yet, enables the light and switch assembly to remain visibly unobtrusive under the cap's bill. Moving the assembly forward would make the assembly more visible and would more significantly alter the appearance of the hat. Moving the assembly rearward would bring the plate into contact with the sweatband subjecting the metal assembly to salt corrosion due to perspiration. The underside fabric of the cap's bill can be a matt surfaced fabric with a dark colored tint to additionally minimize any back glare. Other previous inventions utilizing an under bill lamp assembly such as the Kolibas Combined (Reflective) Visor and Automatic Flash Light (U.S. Pat. No 1,572,210) do not effectively consider the detrimental effects of back glare which will undermine the wearer's night vision. The cap light's lamp placement, use of pre-focused lamps, and the use of a matt, dark colored tint on the underside of the cap's bill effectively eliminates any deleterious back glare.

Figure 1:
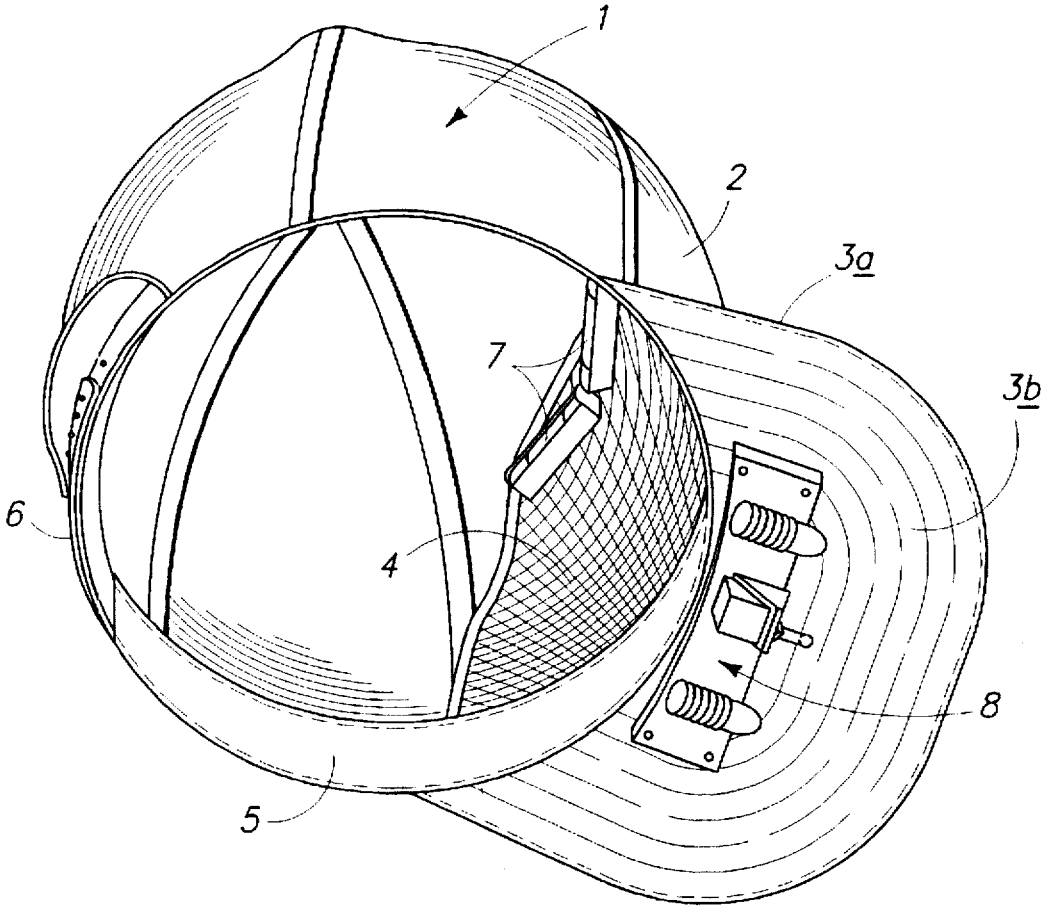
FIG. 1 is a perspective view of the underside of a baseball cap fitted with the light assembly of this invention.
Figure 2:
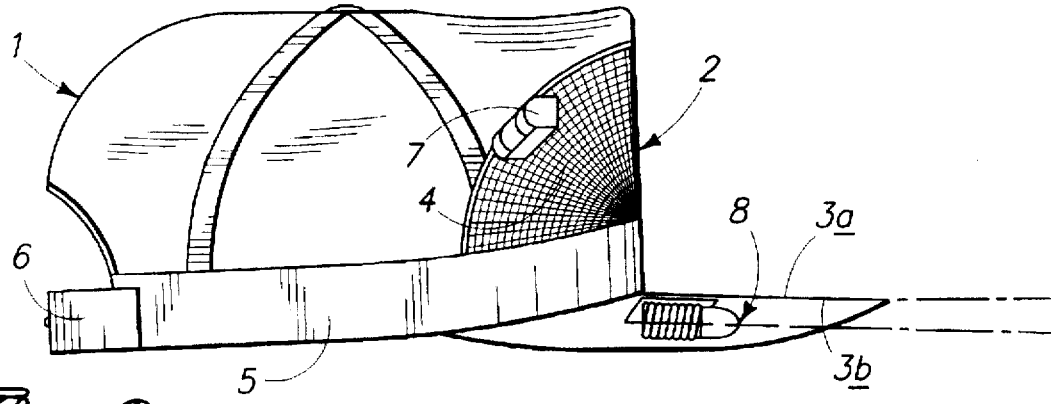
FIG. 2 is a cross section through the longitudinal center of the FIG. 1 cap and light assembly.
Figure 3:
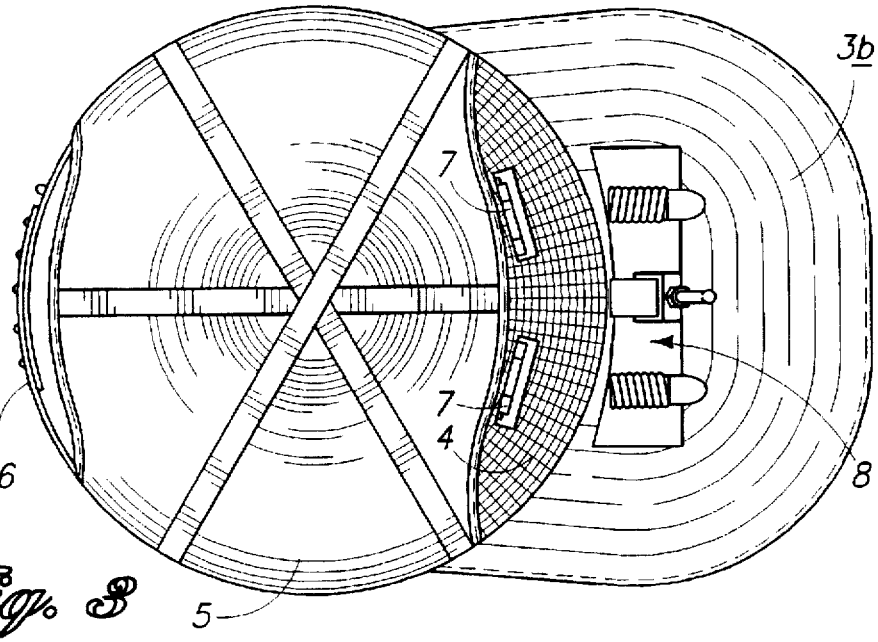
FIG. 3 is a bottom plan view of the FIG. 1 cap and light assembly.
Figure 4:
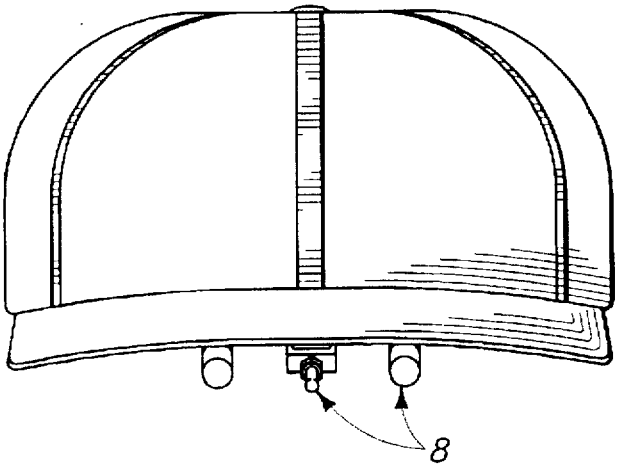
FIG. 4 is a front elevation view of the FIG. 1 cap and light assembly.

FIG. 1, perspective from beneath the cap, FIG. 2, cross section of the cap, FIG. 3, plan view from beneath the cap, and FIG. 4, front view of the cap, generally illustrate the components of the preferred embodiment of the present cap light invention. Reference numeral 1 indicates the common baseball style cap or similar cap, 2 indicates the crown of the cap, 3 indicates the common bill or brim of the cap, with a fabric top surface and bottom surface indicated by numerals 3*a*, and 3*b* respectively, covering an internal plastic or cardboard stiffener, 4 indicates the common interior reinforcement crown liner, 5 indicates the common cap sweatband or liner circumscribing the lower edge of the cap, continuously attached at its lower edge only, to facilitate its ability to fold down, 6 indicates the optional common, two-piece plastic strap enabling cap size adjustment to varying head sizes, 7 indicates the battery assemblies further illustrated in FIG. 5, and 8 indicates the light and switch assembly further illustrated in FIG. 5–7.

FIG. 5 illustrates the detailed embodiment of the battery assemblies. Reference numerals 9a and 9b illustrate two battery carriages (Radio Shack Model Catalog NO 270-401, or equivalent), each holding a single AA sized battery, 10a and 10b, secured by silicon based glue, symmetrically to each side of the reinforcement crown liner 4 at its upper inside edge. Reference numerals 11 and 13 illustrate the positive battery carriage termini, 12 and 14 illustrate the negative battery carriage termini, 17 illustrates the wire connecting the negative battery terminal of battery carriage 9a to the positive battery terminal of battery carriage 9b, and 15 and 16 illustrate the wires leading from the negative terminal 14 of battery carriage 9b and the positive terminal 11 of battery carriage 9a, respectively, to the light and switch assembly 8. This wiring scheme places the two battery carriages 9a and 9b in a series electrical circuit combining in an additive fashion to provide double the voltage of one of the batteries to the light and switch assembly 8.

FIG. 5, switch assembly electrical plan diagram, FIG. 6 switch assembly front elevation, and FIG. 7, switch assembly plan view, illustrate the detailed embodiment of the light and switch assembly 8. Reference numeral 20 illustrates the light and switch assembly 8 mounting plate consisting of a 24 Ga., stainless steel plate approximately 0.75 inches wide and 3.0 inches long, concavely curved along its back edge with an offset of approximately 0.125 inches. The mounting plate 20 has an integrally fabricated switch mounting bracket centered along its length, approximately 0.50 inches wide by 0.50 inches high with pre-punched 0.25 inch diameter hole to receive the threaded mounting sleeve of the sub-mini micro switch (Radio Shack Catalog No. 275-645, or equivalent) 23. Dashed lines on FIG. 7 indicate the pre-folded configuration of the mounting bracket.

Reference numerals 21a and 21b illustrate two commercially available pen light lamp sockets (Radio Shack Catalog No. 272-1124, or equivalent) 22a and 22b, permanently soldered to the mounting plate 20 approximately 0.375 inches from each edge and at an angle of 22.5 degrees to the plane of mounting plate 20 and 3 degrees to a line parallel to the transverse axis of the mounting plate 20. The mounting plate has two small holes at each end to enable mounting to the cap bill 3 with four small brass nuts and bolts.

Reference numerals 15 and 16 illustrate wire leads routed from the battery assemblies 9a and 9b behind the interior reinforcement crown liner 4 and the inside of the cap crown 2, between the cap bill 3 stiffener and its underside fabric liner 3b, to the respective negative lead 24 of the mounting plate 20 and the positive lead 26 of the sub-mini micro switch 23. Reference numerals 18 and 19 illustrate wires connecting the positive terminals 25 and 27 of the sub-mini micro switch 23 with the positive terminals of the pen light sockets 21a and 21b. This arrangement of wiring forms a parallel circuit between the sub-mini micro switch and the pen light sockets. When the switch 23 is placed in the "on" position, the circuit is completed so that the battery assemblies 9a and 9b provide electrical power to the pen light lamps 22a and 22b. The parallel circuit enables the cap light to operate with only one lamp in the event a lamp burns out and a replacement is not immediately available or if the wearer elects to operate the cap light with only one lamp, enabling the cap light to operate for a longer duration.

The cap light invention described is a lightweight, dual high intensity lamp arrangement to be constructed integrally with a standard commercially manufactured baseball style cap with predominantly commercially available parts. As an integral assembly with a standard commercially manufactured baseball style cap, the cap light can be worn without any perceptible change to its usual manner of wear and with minimal visible change to the aesthetics of the common and popular lightweight baseball style cap. The invention described also permits reliable, hands-free operation of a personal lighting device for innumerable work and emergency related tasks. The invention has the special benefit of the ability to maintain illumination of an object or area in the normal close-in focal cone of vision of the wearer by normal movement of the head. Added adjustment to the object or area illuminated is possible by altering the position of the hat on the wearer's head.

While the invention has been described in what is considered its preferred embodiment, other modifications are possible to those skilled in industrial design and manufacturing production. For example, the battery carriages 9a and 9b may be manufactured as a monolithic unit, custom shaped to fit the crown of the cap to enable mass production and easier mounting. The light and switch assembly 8 may be constructed within a custom sealed housing to also enable mass production, water resistance, and ability to integrally color the light and switch assembly to offer the ability to provide a compatible color with the fabrics used to line the underside of the bill 3b.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A combination baseball style cap and light assembly, the cap having a crown, a bill extending from the crown, a sweatband liner circumscribing a bottom edge of the cap, and a reinforcing crown liner, the combination including: a double light and switch assembly comprising first and second lamp sockets affixed to a mounting plate, which plate is in turn affixed to an underside of the bill of the cap; the two lamp sockets having axes that decline at an acute angle to the plate and converge at an acute angle to a line perpendicular to a front edge of the plate, setting a focal point of the lamps at a predetermined location directly out from and generally equidistant between a wearers eyes; a micro switch affixed to an integral mounting flange on the mounting plate located approximately on a center line of the mounting plate between the two sockets; first and second battery holders each affixed respectively to each side of a center line of a top edge of a reinforcing element of the crown of the cap and a top edge of the crown of the cap; and circuit means electrically coupling the micro switch, the lamp sockets and the battery holders.

2. The combination as set forth in claim 1 wherein said circuit means comprises: first and second wires extending from the micro switch through the bill of the cap between an underside fabric and inner stiffener of the cap bill and between a crown stiffener and a backside of the crown to a top of the crown; the first wire being connected to one end of the first battery holder and the second wire connecting to a terminus of the second battery holder; a third wire originating from the first battery holder to a terminus of the second battery holder to effect a series electrical circuit between the first and second battery holders; the two lamp sockets having first and second electrical connections for coupling electrical power to their respective lamps; fourth and fifth wires connected respectively to the first and second electrical connections on each lamp socket and extending to and connected to termini of the micro switch such that the lamp sockets and micro switch effect a parallel electrical circuit between each lamp socket.

3. The combination as set forth in claim 1 wherein each lamp socket comprises a holder for a commercially available single pen light bulb.

4. The combination as set forth in claim 1 wherein each battery holder comprises a holder for a single, commercially available AA size alkaline or rechargeable battery.

5. The combination as set forth in claim 1 wherein each battery holder is affixed to an inside of an upper surface of the crown liner and to the top edge of the crown to ensure wearer comfort, unobtrusive alteration to the cap and reinforcement of the cap.

6. The combination as set forth in claim 1 wherein the light, micro switch and mounting plate assembly are mounted to the underside and 0.125 inches from a back edge of the bill of the cap to minimize visibility of the assembly; to minimize back glare; and to avoid corrosion of the assembly caused by perspiration.

7. The combination as set forth in claim 1 wherein the two lamp sockets are affixed to the mounting plate such that the lamp socket axes are at 22.5 degrees to the plate and 3 degrees to the line perpendicular to the front edge of the plate, setting the focal point of the lamps at a location 22–24 inches directly out from and equidistant between the wearers eyes.

8. The combination as set forth in claim 1 wherein the light, commercially available micro switch and mounting plate assembly consist of the two lamps and the two light sockets to enable a more intense beam of light; light source redundancy in an event one or the other lamp burns out; and to provide the wearer with a choice of removal of one lamp to extend a life of the assembly while still providing light by one lamp.

9. The combination as set forth in claim 1 wherein each light socket is affixed to the mounting plate at horizontal and vertical angles to establish an intersection of the lamp focal length at a distance from the wearer's eye to provide optimal illumination of "arms length" activities while providing good general illumination of objects and surfaces at a greater distance; to alleviate eye strain by focusing each lamp at a point matching a normal human eye focal length position.

10. The combination as set forth in claim 1 wherein the underside fabric of the bill of the cap is a matt dark color to minimize back glare.

* * * * *